US011692425B2

(12) United States Patent
Sidaoui et al.

(10) Patent No.: US 11,692,425 B2
(45) Date of Patent: Jul. 4, 2023

(54) METHOD AND DOWNHOLE APPARATUS TO ACCELERATE WORMHOLE INITIATION AND PROPAGATION DURING MATRIX ACIDIZING OF A SUBTERRANEAN ROCK FORMATION

(71) Applicant: Schlumberger Technology Corporation, Sugar Land, TX (US)

(72) Inventors: Ziad Sidaoui, Dhahran (SA); Mustapha Abbad, Al-Khobar (SA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/233,927

(22) Filed: Apr. 19, 2021

(65) Prior Publication Data

US 2022/0042409 A1 Feb. 10, 2022

Related U.S. Application Data

(60) Provisional application No. 63/060,688, filed on Aug. 4, 2020.

(51) Int. Cl.

| | |
|---|---|
| ***E21B 43/27*** | (2006.01) |
| ***E21B 41/00*** | (2006.01) |
| ***E21B 33/124*** | (2006.01) |

(52) U.S. Cl.

CPC ..... *E21B 43/27* (2020.05); *E21B 41/0078* (2013.01); *E21B 33/124* (2013.01)

(58) Field of Classification Search

CPC .... E21B 33/124; E21B 41/0078; E21B 43/27; E21B 43/16

See application file for complete search history.

(56) References Cited

U.S. PATENT DOCUMENTS

| | | | | |
|---|---|---|---|---|
| 3,050,122 | A | 8/1962 | Huitt | |
| 3,211,221 | A | 10/1965 | Huitt | |
| 3,393,736 | A * | 7/1968 | Goodwin | E21B 43/114 166/276 |
| 4,673,890 | A * | 6/1987 | Copland | E21B 33/124 33/544.2 |
| 4,974,675 | A | 12/1990 | Austin et al. | |
| 9,529,112 | B2 | 12/2016 | Qiu et al. | |
| 10,612,355 | B1 * | 4/2020 | Alruwaili | E21B 33/124 |
| 2011/0284232 | A1 * | 11/2011 | Huang | E21B 34/14 977/775 |
| 2013/0199789 | A1 * | 8/2013 | Liang | G06F 30/20 166/305.1 |
| 2015/0345267 | A1 * | 12/2015 | Modavi | E21B 49/00 703/10 |

(Continued)

FOREIGN PATENT DOCUMENTS

WO WO-2015089669 A1 * 6/2015 ..... E21B 34/06

OTHER PUBLICATIONS

Buijse, M. A.,"Understanding wormholing mechanisms can improve acid treatments in carbonate formations", SPE-65068-PA, SPE Production Facilities, 2020, 15(3), pp. 168-175.

(Continued)

*Primary Examiner* — James G Sayre

(57) ABSTRACT

The present disclosure relates to downhole tools and related methods that accelerate wormhole initiation and propagation during matrix acidizing of a hydrocarbon-bearing subterranean rock formation.

24 Claims, 5 Drawing Sheets

(56) References Cited

U.S. PATENT DOCUMENTS

| | | | | |
|---|---|---|---|---|
| 2016/0024914 | A1 | 1/2016 | Ghommem et al. | |
| 2021/0054735 | A1* | 2/2021 | Alruwaili | E21B 49/006 |
| 2021/0062073 | A1* | 3/2021 | Gomaa | C09K 8/74 |
| 2021/0122970 | A1* | 4/2021 | Mahmoud | E21B 43/26 |

OTHER PUBLICATIONS

Chilingar, et al. "Improving Acidizing Operations", Journal of Sustainable Energy Engineering, 2013, (1(3), pp. 193-197.

Fredd, C. N. et al, "Influence of Transport and Reaction on Wormhole Formation in Carbonate Porous Media", AlChE Journal, 1998, 44(9), pp. 1933-1949.

Ghommem, M. et al., "Carbonate Acidizing: Modeling, analysis, and characterization of wormhole formation and propagation", Journal of Petroleum Science and Engineering, 2015, 131, pp. 18-33.

Golfier, F. et al., "Acidizing Carbonate Reservoirs: Numerical Modelling of Wormhole Propagation and Comparison to Experiments", SPE 68922, presented at the 2001 SPE European Formation Damage Conference, The Hague, The Netherlands, 11 pages.

Gong, M. et al. "Quantitative Model of Wormholing Process in Carbonate Acidizing", SPE 52165, presented at the 1999 SPE Mid-Continent Operations Symposium, Oklahoma City, Oklahoma, U.S.A., 11 pages.

Liu, M. et al., "Wormhole Propagation Behaviour Under Reservoir Condition in Carbonate Acidizing," Transport in Porous Media, 2013, 96, pp. 203-220.

Panga, M. K. R. et al., "Two-scale continuum model in simulation of wormholes in carbonate acidization", AlChE Journal, 2005, pp. 3231-3248.

Ratnaker, R. R. et al., "Modeling, Analysis, and Simulation of Wormhole Formation in Carbonates Rocks with in situ Cross-linked Acids", Chemical Engineering Science, 2013, 90, pp. 179-199.

Tardy, P. M.J. et al., "An Experimentally Validated Wormhole Model for Self-Diverting and Conventional Acids in Carbonate Rocks Under Radial Flow Conditions", SPE 107854, presented at the 2007 European Formation Damage Conference, Scheveningen, The Netherlands, 17 pages.

Wong, S.-U. et al., Near Wellbore Stimulation by Acoustic Waves, SPE 82198, presented at the 2003 SPE European Formation Damage Conference, The Hague, The Netherlands, 6 pages.

* cited by examiner

METHOD AND DOWNHOLE APPARATUS TO ACCELERATE WORMHOLE INITIATION AND PROPAGATION DURING MATRIX ACIDIZING OF A SUBTERRANEAN ROCK FORMATION

CROSS-REFERENCE TO RELATED APPLICATION(S)

The subject disclosure claims priority from U.S. Provisional Appl. No. 63/060,688, filed on Aug. 4, 2020, herein incorporated by reference in its entirety.

FIELD

The subject disclosure relates to matrix acidizing operations that enhance recovery of hydrocarbons from subterranean rock formations.

BACKGROUND

The rate of hydrocarbon recovery from hydrocarbon-bearing subterranean rock formations (i.e., subterranean hydrocarbon reservoirs) is governed by the interplay of viscous and capillary forces that determine fluid transport in porous media, and several enhanced recovery techniques have been devised to increase the rate and completeness of fluid transport. One type of enhanced recovery technique is commonly referred to as matrix acidizing, which involves the supply or injection of fluidic chemical agents such as acids and other materials into the near-wellbore area of a hydrocarbon-bearing subterranean rock formation at pressures below formation fracture pressure to restore or enhance the permeability of the rock formation. The matrix acidizing is often carried out following damage to the near-wellbore area following drilling and fracturing operations. As the fluidic chemical agent (referred to herein as a "stimulating fluid") contacts the rock formation at a treatment site or zone, formation rock (often carbonates) at or near the treatment site or zone can react to the stimulating fluid and undergo dissolution reactions that produce highly permeable channels or "wormholes" that enable fluid transport through the rock formation. Successful matrix acidizing is often characterized by the production of dominant wormholes that may have some degree of branching but extend into the rock formation and consume minimal amounts of stimulating fluid.

Although matrix acidizing is relatively common, the evaluation of the matrix acidizing process and recovery enhancement is difficult to characterize. Some common parameters monitored during a matrix acidizing process include injection pressure, injection rate, downhole pressures, and distributed temperature, which can be related to the extent of the reaction of the formation rock with the stimulating fluid. However, techniques such as temperature monitoring are unreliable in many circumstances, and improper stimulation and zonal coverage may not be discovered until the production phase, when remediation is expensive and time consuming. It is important to optimize the efficiency of the matrix acidizing operations.

SUMMARY

In an embodiment, a method is provided for stimulating recovery of hydrocarbons from a subterranean rock formation traversed by a wellbore, which involves deploying a downhole tool at a treatment zone of the wellbore. The downhole tool is operated to create at least one notch in a wellbore surface at the treatment zone and to inject or supply a stimulating fluid to the treatment zone at a pressure less than formation breakdown pressure. The notch facilitates wormhole formation at a corresponding position of the notch arising from dissolution of rock caused by reaction of the rock with the stimulating fluid.

In embodiments, the notch can facilitate wormhole formation by jump-starting wormhole initiation.

In embodiments, the notch can reduce an induction time period.

In embodiments, the notch can provide for controlled placement of a corresponding wormhole.

In embodiments, the notch can provide for reducing volume of the stimulation fluid injected into the wellbore as compared to a volume of the stimulation fluid injected into the wellbore where no notches are present.

In embodiments, the notch can be created by a nozzle structure that is configured to direct a high-pressure flow of stimulating fluid to a localized area of the wellbore surface.

In embodiments, the downhole tool can be operated to create the at least one notch prior to supplying the stimulating fluid to the treatment zone at a pressure less than formation breakdown pressure.

In embodiments, the downhole tool can be operated to create the at least one notch simultaneously with supplying the stimulating fluid to the treatment zone at a pressure less than formation breakdown pressure.

In embodiments, the downhole tool can be operated to create the at least one notch and supply the stimulating fluid to the treatment zone at a pressure less than formation breakdown pressure after isolating the treatment zone of the wellbore.

In embodiments, the operation of the downhole tool can create a plurality of notches in the wellbore surface of the treatment zone, wherein the plurality of notches facilitates wormhole formation at corresponding positions of the plurality of notches.

In embodiments, the plurality of notches can be created by a plurality of nozzle structures each configured to direct a high-pressure flow of stimulating fluid to a localized area of the wellbore surface.

In embodiments, the stimulating fluid can include an acid component.

In embodiments, a downhole tool is provided that is deployable in a wellbore that traverses a subterranean rock formation traversed by a wellbore. The downhole tool can be used to stimulate recovery of hydrocarbons from the subterranean rock formation. The downhole tool can be configured to create at least one notch in a wellbore surface at a treatment zone and to supply a stimulating fluid to the treatment zone at a pressure less than formation breakdown pressure in a single run. The notch facilitates wormhole formation at a corresponding position of the notch arising from dissolution of rock caused by reaction of the rock with the stimulating fluid.

In embodiments, the downhole tool can include packers spaced apart from one another and configured to isolates the treatment zone.

In embodiments, the downhole tool can include a sliding sleeve configured to selectively inject the stimulating fluid into the treatment zone.

In embodiments, the downhole tool can include at least one nozzle structure supported by at least one moveable arm, wherein the nozzle structure is configured to direct a high-pressure flow of stimulating fluid to a localized area of the wellbore surface to create the notch.

In embodiments, the at least one moveable arm can be configured for radial movement to permit the at least one nozzle structure to contact the wellbore surface.

In embodiments, the at least one moveable arm can include at least one internal fluid passageway configured to carry stimulating fluid to the at least one nozzle structure.

In embodiments, the at least one moveable arm can include at least one nozzle valve in fluid communication with the at least one internal fluid passageway, wherein the at least one nozzle valve is configured to selectively supply stimulating fluid to the at least one nozzle structure via the at least one internal fluid passageway.

In embodiments, the nozzle structure can include at least one pad disposed about a nozzle exit. The at least one pad can be configured to contact the wellbore surface and provide a stand-off distance between the wellbore surface and the nozzle exit.

In embodiments, the nozzle structure can be configured such that the stand-off distance is fixed.

In embodiments, the nozzle structure can be configured such that the stand-off distance is adjustable by hydraulic operation or electromechanical operation.

In embodiments, the nozzle structure can be configured to provide a flow path of stimulating fluid leading to the nozzle exit, wherein the flow path has decreasing cross-sectional size over its length such that pressure and velocity of stimulating fluid increases over the flow path and exits from the nozzle exit at sufficient pressure and velocity to create a notch in the wellbore surface.

In embodiments, the downhole tool can include a plurality of nozzle structures supported by at least one moveable arm, wherein each nozzle structure is configured to direct a high-pressure flow of stimulating fluid to a localized area of the wellbore surface to create a plurality of notches.

In embodiments, the plurality of nozzle structures can be supported by a plurality of moveable arms.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

The subject disclosure is further described in the detailed description below, in reference to the noted plurality of drawings by way of non-limiting examples of the subject disclosure, in which like reference numerals represent similar parts throughout the several views of the following drawings, and wherein.

DETAILED DESCRIPTION

Figure 1:
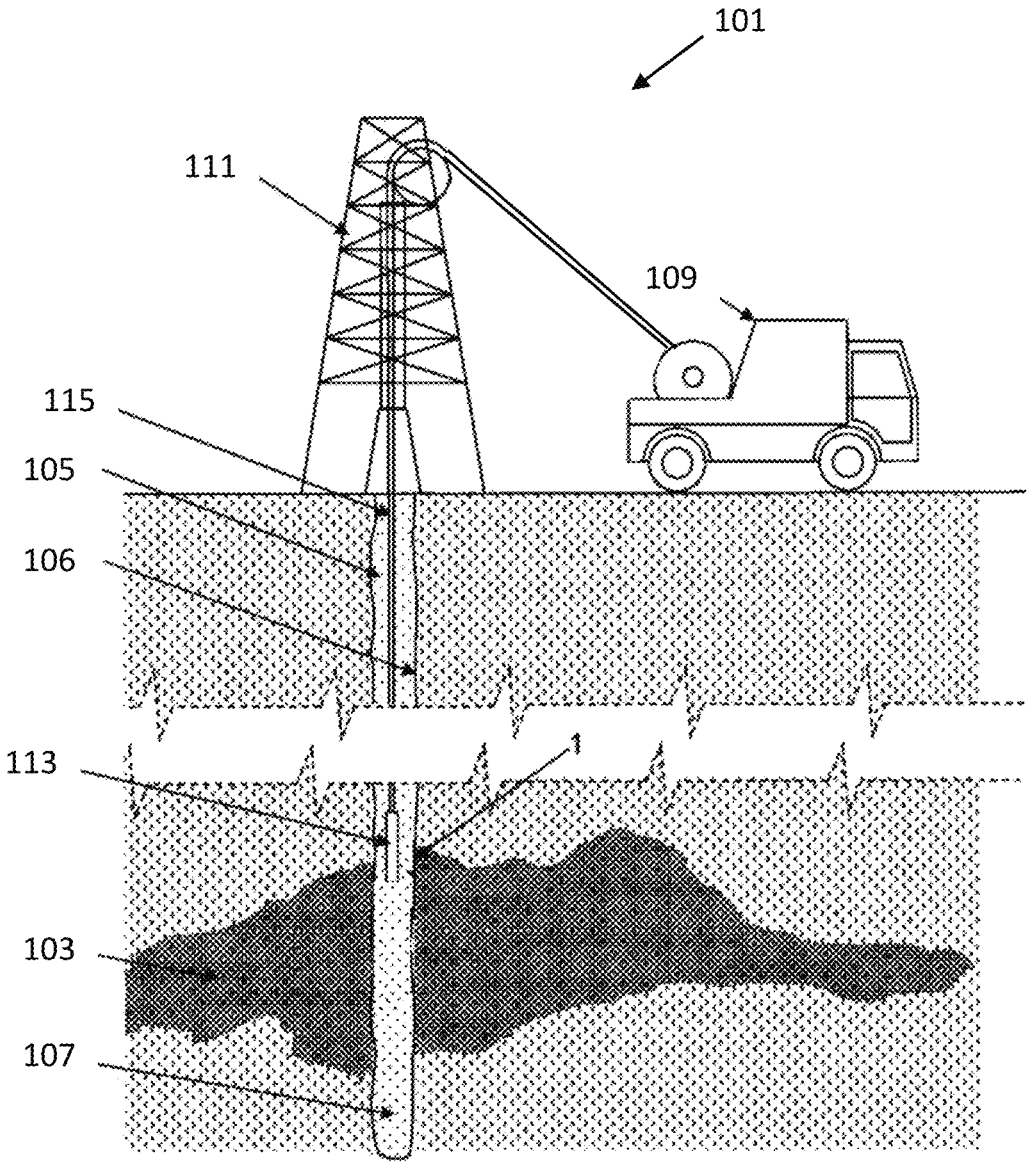
FIG. 1 is a schematic diagram of a wellsite with equipment provided for creating notches in a wellbore surface and for matrix acidizing a subterranean rock formation.

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

Matrix acidizing involves the injection or supply stimulating fluid (e.g. hydrochloric acid) into the near-wellbore area of a hydrocarbon-bearing subterranean rock formation at a pressure below the formation fracturing pressure. As the stimulating fluid contacts the subterranean rock formation at a treatment site or zone, the formation rock (often carbonates) at or near the treatment site or zone can react to the stimulating fluid and undergo dissolution reactions that produce highly permeable channels or "wormholes" that extend radially (i.e., in a direction with a radial component orthogonal to the central axis of the wellbore) through the rock formation and enable fluid transport through the rock formation, which can restore or enhance the permeability of the rock formation.

In embodiments, the process that forms such wormholes at a treatment site or zone can be logically partitioned into two time periods: an induction time period and a wormholing time period. The induction time period is the time from the first injection of the stimulation fluid to initiate one or more wormholes at the treatment site or zone. The wormholing time period is the time period that one or more wormholes propagate by further dissolution of the formation rock and extend radially into the rock formation. The volume of stimulation fluid injected during the induction time period can be greater than thirty percent of the total volume required for the matrix acidizing operations. Hence, minimizing the induction time period can significantly reduce the cost and time of matrix acidizing operations.

In the subject disclosure, a method and a downhole tool are described. The method and downhole tool create notches in a surface of a wellbore. Each notch can facilitate wormhole formation at a corresponding position of the notch by jump-starting wormhole initiation (i.e., the dissolution of the formation rock) and reducing the induction time period. In embodiments, the notches are created by one or more nozzle structures that are configured to direct a high-pressure flow or jet of stimulating fluid to a localized area of the wellbore surface. The created notches establish a least resistant path to the stimulating fluid that contacts the wellbore surface during the matrix acidizing operation. The created notches act as seeds for wormholes formed by the matrix acidizing operation and thus result in controlled placement of the wormholes and ultimately a reduction of the volume of the stimulating fluid required for the matrix acidizing operation.

Notching the formation has been applied to hydraulic fracturing because it creates weak points and reduces the pressure required to fracture the formation.

In the subject disclosure, a method and a downhole tool is provided for creating notches to accelerate wormhole initiation. The resultant notches can minimize the required volume of stimulation fluid used for the matrix acidizing operation. This is achieved by creating one or more notches in the wellbore surface prior to or while injecting the stimulation fluid. Furthermore, this method enables more selective placement of the stimulating fluid.

The subject disclosure is based on mechanically inducing or creating shallow notches in a wellbore surface by employing a downhole tool prior to or while injecting stimulation fluid to direct the wormhole formation and propagation in the wellbore surface and to minimize the volume of stimulation fluid needed to do the operation.

In an embodiment, a downhole tool is provided that creates shallow notches in a wellbore surface and in the same run (of the tool) performs matrix acidizing operations to stimulate the formation.

FIG. 1 is a schematic diagram that illustrates an example onshore hydrocarbon well location with surface equipment 101 above a hydrocarbon-bearing subterranean rock formation 103 after a drilling operation has been carried out. At this stage, the wellbore 105 is filled with a fluid mixture 107 which is typically a mixture of drilling fluid and drilling mud. In subsequent stages, the well is typically completed by running one or more casing strings in the wellbore 105 before cementing operations that cement the casting string(s) to the wellbore surface 106. In this example, the surface equipment 101 comprises a surface unit 109 and rig (or injector) 111 for deploying a downhole tool 113 in the wellbore 105. The surface unit 109 may be a vehicle coupled to the downhole tool 113 by coiled tubing or other tubing 115. Furthermore, the surface unit 109 can include an appropriate device for determining the depth position of the downhole tool 113 relative to the surface level.

Figures 2A, 2B:
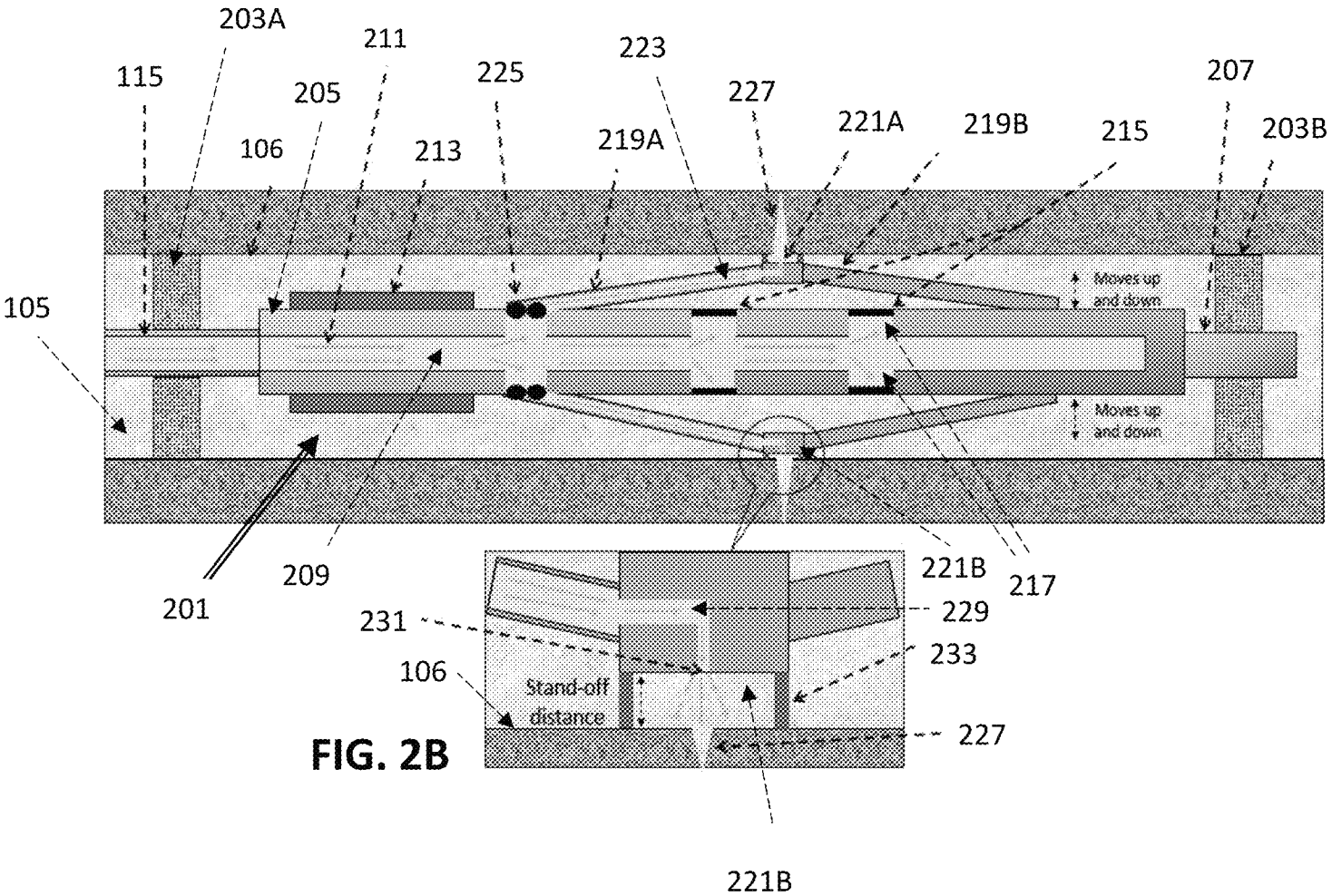
FIGS. 2A and 2B are schematic diagrams of an illustrative downhole tool for creating notches in a wellbore surface and for matrix acidizing a subterranean rock formation.

In one embodiment illustrated in FIGS. 2A and 2B, the downhole tool 113 includes a bottom hole assembly (BHA) 201 supported by a connection to the coiled tubing 115. The BHA 201 includes one or more packers 203A disposed at or near the connection to the coiled tubing 115. A tool housing 205 extends axially away from the connection to the coiled tubing 115 to a dummy tail 207 that supports one or more packer(s) 203B. In this manner, the packer(s) 203A are spaced axially from the packer(s) 203B. As the BHA 201 is run in the wellbore 105, the packers 203A, 203B can be activated to contact the wellbore wall 106 to isolate a treatment zone of the wellbore 105, which is the annular space of the wellbore 105 between the packer(s) 203A and the packer(s) 203B.

The tool housing 205 has a central channel 209 that is in fluid communication with the interior tubular channel of the coiled tubing 115. During operations, stimulating fluid 211 is pumped from the surface by the surface equipment 101 through the interior tubular channel of the coiled tubing 115 and into the central channel 209 of the tool housing 205. The tool housing 205 supports an actuation system 213 and a sliding valve or sleeve 215 disposed between the packer(s) 203A and the packer(s) 203B such that the actuation system 213 and sliding valve 215 are operably disposed in the treatment zone of the wellbore 105 as shown. During wormhole formation operations carried out by the tool (which encompass the induction and wormholing time periods as described herein), the movement of the sliding valve or sleeve 215 in a direction parallel to the central axis of the tool housing 205 can be actuated by the actuation system 213 to selectively open one or more ports 217 leading from central channel 209 of the tool housing 205 to the treatment zone to provide for flow of the stimulating fluid 211 from the central channel through the port(s) 217 and into the treatment zone. Such movement can optionally provide for choking that can selectively vary the flow rate of the stimulating fluid 211 from the central channel 209 through the port(s) 217 and into the treatment zone. The movement of the sliding valve or sleeve 215 in an opposite direction parallel to the central axis of the tool housing 205 can be actuated by the actuation system 213 to close the port(s) 217 to block the flow of the stimulating fluid from the central channel 209 and through the port(s) 217.

The tool housing 205 further supports at least one arm (e.g., two arms shown as 219A, 219B) that are disposed about the exterior surface of the tool housing 205 between the packer(s) 203A and the packer(s) 203B such that the at least one arm is operably disposed in the treatment zone of the wellbore 105. In embodiments, the at least one arm (e.g., arms 219A, 219B) is disposed adjacent the sliding valve 215 as shown. The least one arm (e.g., arms 219A, 219B) is configured such that it is actuated by the actuation system 213 to move radially away from the tool housing 205 toward the wellbore surface 106 (and also for opposite radial movement away from the wellbore surface 106 toward the tool housing 105). The at least one arm (e.g., arms 219A, 219B) supports at least one nozzle structure (e.g., two nozzle structures 221A, 221B). The at least one arm (e.g., arm 219A) also includes at least one internal fluid passageway 223 that extends between the at least one nozzle structure (e.g., two nozzle structures 221A, 221B) and corresponding nozzle valve(s) 225 fluidly coupled to the central channel 209 of the tool housing 205. The nozzle valve(s) 225 can be actuated by the actuation system 213 into an open configuration or closed configuration. In the open configuration of the nozzle valve(s) 225, stimulating fluid 211 flows from the central channel 209 and into the fluid passageway(s) 223 for supply to the at least one nozzle structure (e.g., two nozzle structures 221A, 221B). In the closed configuration of the nozzle valve(s) 225, the flow of stimulating fluid 211 from the central channel 209 and into the fluid passageway(s) 223 is blocked. During a notching operation carried out by the tool, the at least one arm (e.g., arms 219A, 219B) can be moved radially such that the at least one nozzle structure (e.g., two nozzle structures 221A, 221B) contacts the wellbore surface 106 in the treatment zone and the nozzle valve(s) 225 can be actuated into the open configuration such that stimulating fluid 211 flows from the central channel 209 to the at least nozzle structure (e.g., two nozzle structures 221A, 221B). The nozzle structure is configured to direct a high-pressure flow or jet of the stimulating fluid 211 to a localized area of the wellbore surface 106 adjacent the nozzle structure, which creates a shallow notch 227 that extends radially into the wellbore surface 106 as best shown in FIG. 2B. After the notching operation is completed, the at least one arm (e.g., arms 219A, 219B) can be configured such that it is actuated by the actuation system 213 to retract radial inward away from the wellbore surface 106 toward the tool housing 105 to permit axial movement of the BHA 201 and setting the BHA 201 at a desired interval of the wellbore 105.

In the embodiment of FIGS. 2A and 2B, the nozzle structure (e.g., nozzle structure 221A or 221B) defines a fluid channel 229 with an inlet end in fluid communication with the passageway 223. The fluid channel 229 extends through the nozzle structure (for example, with a ninety-degree turn) to a nozzle exit 231. The fluid channel 229 provides a flow path of decreasing cross-sectional size over its length such that the pressure and velocity of the stimulating fluid increases over the flow path and exits from the nozzle exit 231 at sufficient pressure and velocity to create the desired notch in the wellbore surface 106. One or more pads 233 are disposed about the nozzle exit 231 and configured to extend radially and contact the wellbore surface 106 as shown. The pad(s) 233 provide a predefined or fixed stand-off distance between the nozzle exit 231 and the wellbore surface 106 during the notching operation as best shown in FIG. 2B.

The actuation system 213 can employ one or more electric motors (whether regular or a stepper motor) and solenoids (whether a single solenoid or multiple solenoids), and/or hydraulic systems, etc. Electric power can be provided from a surface-located electrical power source and communicated downhole by conductors, or by a downhole electrical power source such as batteries or capacitors. Hydraulic power can be provided from a surface-located hydraulic power source and communicated downhole by hydraulic lines, or by a downhole hydraulic power source such as a downhole hydraulic motor driven by the flow of stimulating fluid carried downhole to the tool by the coiled tubing. The complexity of the actuation system 213 can vary and depend upon whether the sliding valve or sleeve, arm(s) and valves of the tool are actuated individually or in groups, which may require multiple actuator or bridging systems within the tool. Multiple actuators may be staggered relative to one another to permit for integration as part of the tool.

In embodiments, the BHA 201 can be moved axially within the wellbore 105 and then set at a desired interval of the wellbore 105 by activating the packers 203A, 203B to contact the wellbore wall 106 to isolate a treatment zone of the wellbore 105, which is the annular space of the wellbore 105 between the packer(s) 203A and the packer(s) 203B, and the stimulating fluid 211 can be supplied to the BHA 201 via the coiled tubing 115. The BHA 201 can be configured to perform the notching operation prior to wormhole formation operations as described herein.

During the notching operation, the sliding valve 215 can be positioned such that it closes the port(s) 217 to block the flow of the stimulating fluid 211 from the central channel 209 and through the port(s) 217. Furthermore, the at least one arm (e.g., arms 219A, 219B) can be moved radially such that the at least one nozzle structure (e.g., two nozzle structures 221A, 221B) contacts the wellbore surface 106 in the treatment zone and the nozzle valve(s) 225 can be actuated into its open configuration such that stimulating fluid 211 flows from the central channel 209 to the nozzle structure(s). The or each nozzle structure is configured to direct a high-pressure flow of the stimulating fluid 211 to a localized area of the wellbore surface 106 adjacent the nozzle structure, which creates a shallow notch 227 that extends radially into the wellbore surface 106 as best shown in FIG. 2B. Once the notching operation is complete, the nozzle valve(s) 225 can be actuated into its closed configuration such that passageway 223 and nozzle structure(s) is (are) fluidly isolated from the central channel 209 and thus blocking the flow of stimulating fluid 211 from the central channel 209 to the nozzle structure(s). Furthermore, the at least one arm (e.g., arms 219A, 219B) can optionally be retracted radial inward away from the wellbore surface 106 toward the tool housing 105 to permit axial movement of the BHA 201.

During the wormhole formation operations that follow the notching operation, the nozzle valve(s) 225 can be operated in its closed configuration such that passageway 223 and the nozzle structure(s) are fluidly isolated from the central channel 209 and thus blocking the flow of stimulating fluid 211 from the central channel 209 to the nozzle structure(s). Furthermore, the sliding valve 215 is configured to open one or more ports 217 leading from central channel 209 of the tool housing 205 to the treatment zone to provide for flow of the stimulating fluid 211 from the central channel 209 through the port(s) 217 and into the treatment zone. As the stimulating fluid contacts the rock formation at the treatment zone, the formation rock at the treatment zone can react to the stimulating fluid and undergo dissolution reactions that produce highly permeable channels or "wormholes" that extend radially (i.e., in a direction with a radial component) through the rock formation and enable fluid transport through the rock formation, which can restore or enhance the permeability of the rock formation. The one or more shallow notches 227 in the wellbore surface 106 that are created by the notching operation can facilitate wormhole formation at a corresponding position of the notch by jump-starting wormhole initiation (i.e., the dissolution of the formation rock) and reducing the induction time period. Specifically, such notch(es) 227 establish a least resistant path to the stimulating fluid that contacts the wellbore surface 106 during the wormhole formation operations. Such notch(es) 227 can act as seed(s) for wormholes formed by the matrix acidizing operation, and thus result in controlled placement of the wormholes and ultimately a reduction of the volume of the stimulating fluid required for the matrix acidizing operation.

In one embodiment, the BHA 201 can be configured with four nozzle structures that are spaced apart from one another about the circumferential surface of the tool housing 205. The four nozzle structures can be supported by eight movable arms where each one of the four-nozzle structure is mounted on a pair of moveable arms with one arm of the pair proving a respective fluid passageway from a corresponding nozzle valve to the respective nozzle structure. At a resting position, all the four nozzle valves are closed, and all eight arms are positioned near the tool housing 205 and flat. The arms are actuated to move away from the tool housing 205 toward the wellbore surface 106, which carry the four nozzle structures away from the tool housing 205 and cause the four nozzle structures to contact the wellbore surface 106 with an initial stand-off distance ensured by the pad(s) 223 of the respective nozzle structures. At this point, the four nozzle valves are opened which enable the stimulation fluid to flow through the fluid passageways provided by the four movable arms to reach the respective nozzle structures. The stimulation fluid increases its velocity as the flow path size get smaller ensuring enough velocity to create the desired notch in the wellbore surface 106. After the notching operation is complete, the four nozzle valves can be closed, and the arms retracted or moved radially inward toward the tool housing. Furthermore, the sliding sleeve can be actuated to open the one or more ports 217 between the central channel 209 and the treatment zone to perform follow-on wormhole formation operations. Once the wormhole formation operations are complete, the sliding sleeve can be actuated to close the one or more ports 217 between the central channel 209 and the treatment zone, the packer(s) 203A and the packer (s0 203B can be deactivated, and the tool can be moved axially in the wellbore 105 for use in the next target zone or possibly removed from the wellbore 105.

In other embodiments, the BHA 201 can be configured to perform the notching operation simultaneously with the wormhole formation operations. In this embodiment, the sliding valve 215 can be configured to open the one or more ports 217 leading from central channel 209 of the tool housing 205 to the treatment zone to provide for flow of the stimulating fluid 211 from the central channel 209 through the port(s) 217 and into the treatment zone. Concurrent with the sliding valve 215, positioned such that it opens the port(s) 217 to provide for the flow of the stimulating fluid 211 from the central channel 209 and through the port(s) 217, the at least one arm (e.g., arms 219A, 219B) can be positioned such that the at least one nozzle structure (e.g., two nozzle structures 221A, 221B or possibly additional nozzle structures) contacts the wellbore surface 106 in the treatment zone and the nozzle valve(s) 225 can be actuated into open configuration such that stimulating fluid 211 flows from the central channel 209 to the nozzle structure(s). The respective nozzle structure is configured to direct a high-pressure flow of the stimulating fluid 211 to a localized area of the wellbore surface 106 adjacent the nozzle structure, which creates a shallow notch 227 that extends radially into the wellbore surface 106 as best shown in FIG. 2B. Concurrent with the notching operation, the stimulating fluid that flows from the central channel 209 through the port(s) 217 and into the treatment zone contacts the rock formation at the treatment zone. The formation rock at the treatment zone can react to the stimulating fluid and undergo dissolution reactions that produce highly permeable channels or "wormholes" that extend radially (i.e., in a direction with a radial component) through the rock formation and enable fluid transport through the rock formation, which can restore or enhance the permeability of the rock formation. In this embodiment, the notch(es) 227 created by the notching operation can facilitate wormhole formation at a corresponding position of the notch by jump-starting wormhole initiation (i.e., the dissolution of the formation rock), aid in jump-starting wormhole initiation and reducing the induction time period. Specifically, such notch(es) 227 can establish a least resistant path to the stimulating fluid that contacts the wellbore surface 106 during the wormhole formation operations. Such notch(es) 227 can act as seed(s) for wormholes formed by the matrix acidizing operation, and thus result in controlled placement of the wormholes and ultimately a reduction of the volume of the stimulating fluid required for the matrix acidizing operation. Once the notching operation is complete, the nozzle valve 225 can be actuated into its closed configuration such that passageway 223 and nozzle structure(s) is (are) fluidly isolated from the central channel 209 and thus blocking the flow of stimulating fluid 211 from the central channel 209 to the nozzle structure(s). Furthermore, the at least one arm (e.g., arms 219A, 219B) can optionally be configured such that it is actuated by the actuation system 213 to retract radial inward away from the wellbore surface 106 toward the tool housing 105 to permit axial movement of the BHA 201.

In another embodiment, the respective nozzle structure(s) of the tool can be adapted such that the stand-off distance between the nozzle exit and the wellbore surface can be adjusted according to operation needs by hydraulic operation. In non-limiting examples, the opening of the nozzle is about 1/32-1/16 inch. In non-limiting examples, the depth of the notches (depends on the stand-off distance) is expected to be greater than about 1 inch.

Figure 3A:
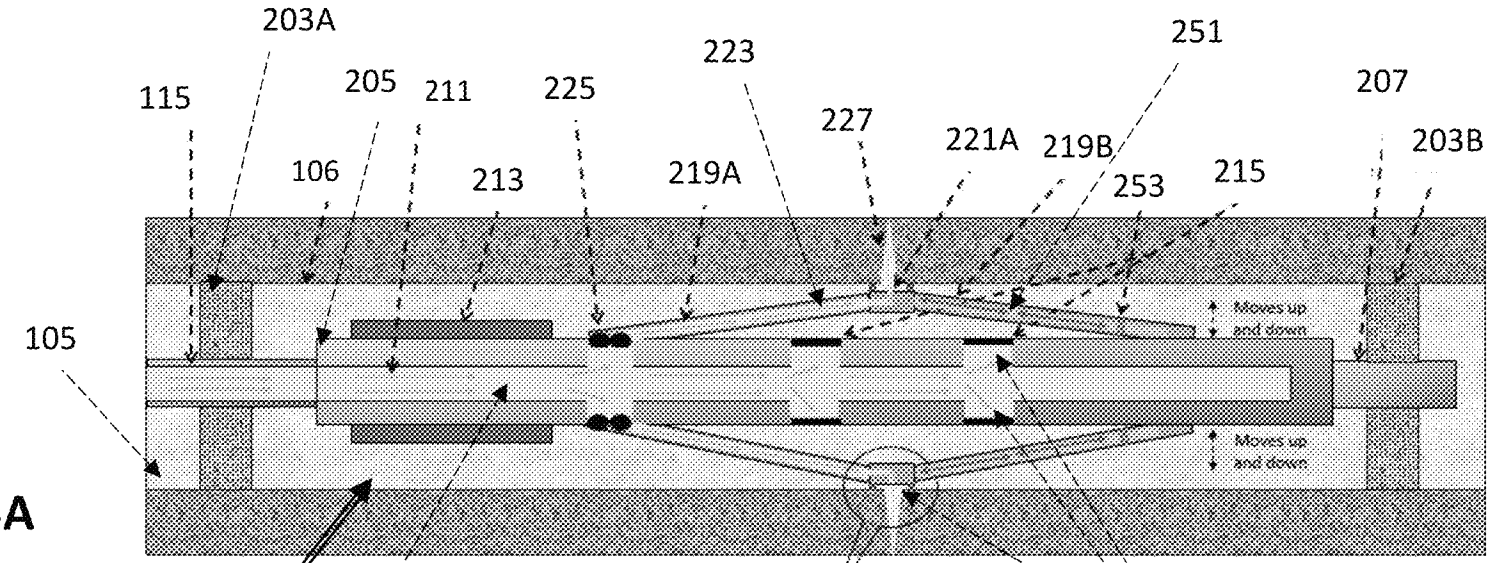
FIGS. 3A and 3B are schematic diagrams of another illustrative downhole tool for creating notches in a wellbore surface and for matrix acidizing a subterranean rock formation.
Figure 3B:
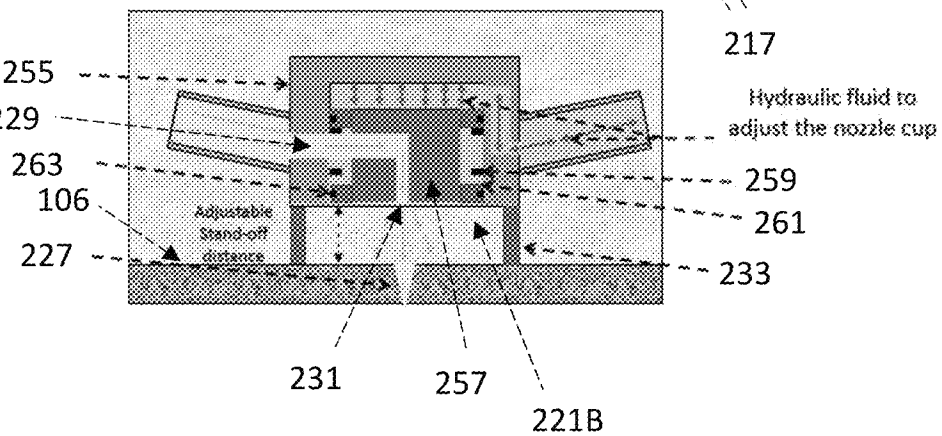

In this case, the moveable arm(s) (e.g., moveable arms 219B) of the tool can be configured to provide a corresponding internal channel 251 to carry hydraulic fluid to the respective nozzle structures as shown in FIGS. 3A and 3B. The pressure of the hydraulic fluid can be controlled by a piston 253 integral to the moveable arm(s) (e.g., moveable arms 219B). Furthermore, the respective nozzle structures can be configured to have a moveable cup 255 that houses a nozzle body 257. The cup 255 is moveable in the radial direction relative to the nozzle body 257 and defines a variable volume interior chamber between the cup 255 and the nozzle body 257. The variable volume interior chamber is in fluid communication with the internal passageway 251, such hydraulic fluid pressure controlled by the piston 253 controls the volume of the interior chamber and moves the cup 255 radially relative to the nozzle body 257. The radial movement of the cup 255 is supported by a stopper 259, seal 261 and O-ring 263 using the pressure of the hydraulic fluid. The cup 255 and nozzle body 257 further define a fluid channel 229 with an inlet end in fluid communication with the passageway 223. The fluid channel 229 extends through the nozzle body (for example, with a ninety-degree turn) to a nozzle exit 231. The fluid channel 229 provides a flow path of decreasing cross-sectional size over its length such that the pressure and velocity of the stimulating fluid increases over the flow path and exits from the nozzle exit 231 at sufficient pressure and velocity to create the desired notch in the wellbore surface 106. One or more pads 233 are disposed about the nozzle exit 231 and configured to extend radially from the moveable cup 225 and contact the wellbore surface 106 as shown. The moveable cup 255 and pad(s) 233 provide an adjustable stand-off distance between the nozzle exit 231 and the wellbore surface 106 during the notching operation as best shown in FIG. 3B.

In this embodiment, after deploying the nozzle structure(s) near the wellbore surface 106, the stand-off distance can be adjusted by the hydraulic operations, if need be. The nozzle valve(s) can be opened to enable the stimulation fluid to flow to the nozzle structure(s). The respective nozzle structure(s) increase the fluid velocity of the stimulation fluid as the flow path sizes get smaller ensuring enough velocity to form a notch. After the notching operation is complete, the nozzle valve(s) can be closed, and the arm(s) of the tool can be retracted in the radial direction. Furthermore, the sliding sleeve can be actuated to open the one or more ports 217 between the central channel 209 and the treatment zone to perform follow-on wormhole formation operations. Once the wormhole formation operations are complete, the sliding sleeve can be actuated to close the one or more ports 217 between the central channel 209 and the treatment zone, the packer(s) 203A and the packer(s) 203B can be deactivated, and the tool can be moved axially in the wellbore 105 for use in the next target zone or possibly removed from the wellbore 105.

Figure 4A:
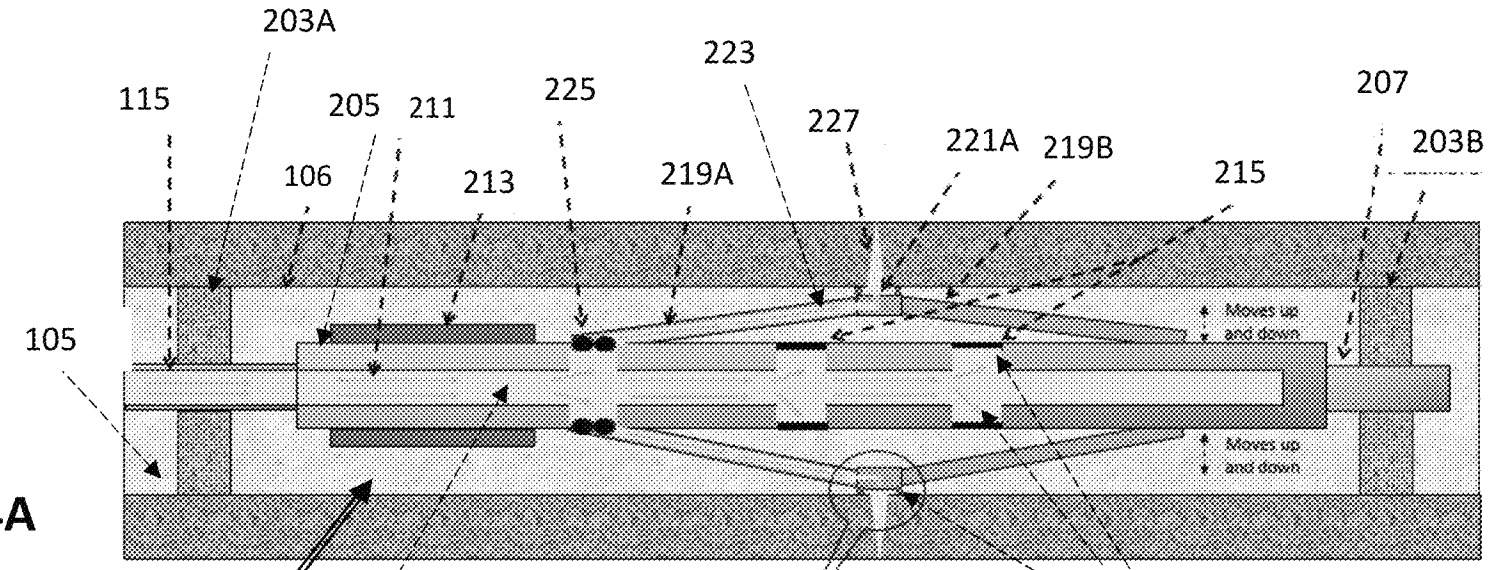
FIGS. 4A and 4B are schematic diagrams of yet another illustrative downhole tool for creating notches in a wellbore surface and for matrix acidizing a subterranean rock formation.
Figure 4B:
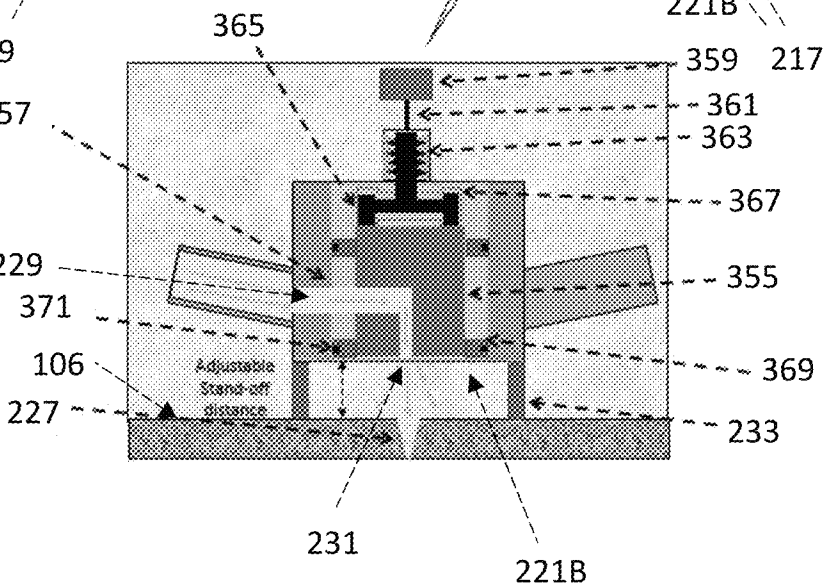

In another embodiment, the respective nozzle structure(s) of the tool can be adapted such that the stand-off distance between the nozzle exit and the wellbore surface can be adjusted according to operation needs by electromechanical operation. In this case, the respective nozzle structure(s) can be configured to have a moveable nozzle cup 355 housed by a nozzle body 357 as shown in FIGS. 4A and 4B. The nozzle cup 355 is moveable in the radial direction relative to the nozzle body 357 by operation of an electric motor 359, drive wire 361, threaded part 363, and pusher 365. The electrical motor 259 and drive wire 361 drive rotation of the pusher 363, which is threaded to the threaded part 363 to impart radial movement of the nozzle cup 355 relative to the nozzle body 357. The movement of the pusher 365 is restricted by the stopper 367, which houses the pusher 365. The nozzle cup 355 interfaces to O-rings 369 with seals 371 to facilitate its movement. The nozzle cup 355 and nozzle body 357 define a fluid channel 229 with an inlet end in fluid communication with the passageway 223. The fluid channel 229 extends through the nozzle cup 355 (for example, with a ninety-degree turn) to a nozzle exit 231. The fluid channel 229 provides a flow path of decreasing cross-sectional size over its length such that the pressure and velocity of the stimulating fluid increases over the flow path and exits from the nozzle exit 231 at sufficient pressure and velocity to create the desired notch in the wellbore surface 106. One or more pads 233 are disposed about the nozzle exit 231 and extend radially from the nozzle body 357 to contact the wellbore surface 106 as shown. The moveable cup 355 provides an adjustable stand-off distance between the nozzle exit 231 and the wellbore surface 106 during the notching operation as best shown in FIG. 4B.

In this embodiment, after deploying the nozzle structure(s) near the wellbore surface 106, the stand-off distance can be adjusted by the electromechanical operations, if need be. The nozzle valve(s) can be opened which enable the stimulation fluid to flow to the nozzle structure(s). The respective nozzle structure(s) increase the fluid velocity of the stimulation fluid as the flow path sizes get smaller ensuring enough velocity to form a notch. After the notching operation is complete, the nozzle valve(s) can be closed, and the arm(s) can be retracted in the radial direction. Furthermore, the sliding sleeve can be actuated to open the one or more ports 217 between the central channel 209 and the treatment zone to perform follow-on wormhole formation operations. Once the wormhole formation operations are complete, the sliding sleeve can be actuated to close the one or more ports 217 between the central channel 209 and the treatment zone, the packer(s) 203A and the packer(s) 203B can be deactivated, and the tool can be moved axially in the wellbore 105 for use in the next target zone or possibly removed from the wellbore 105.

Figure 5:
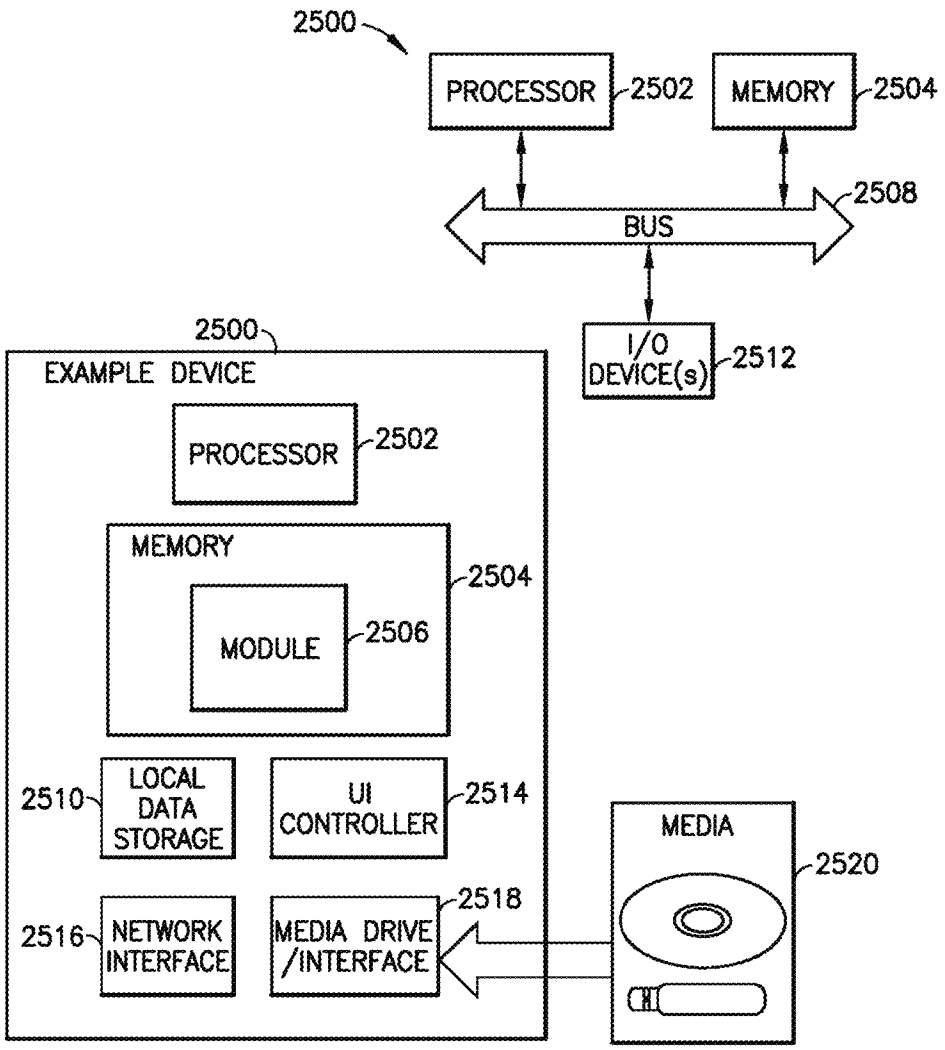
FIG. 5 illustrates a schematic view of a computing system according to an embodiment of the present disclosure.

FIG. 5 illustrates an example device 2500, with a processor 2502 and memory 2504 that can be configured to implement various embodiments of the methods and processes as discussed in the present application. Memory 2504 can also host one or more databases and can include one or more forms of volatile data storage media such as random-access memory (RAM), and/or one or more forms of non-volatile storage media (such as read-only memory (ROM), flash memory, and so forth).

Device 2500 is one example of a computing device or programmable device and is not intended to suggest any limitation as to scope of use or functionality of device 2500 and/or its possible architectures. For example, device 2500 can comprise one or more computing devices, programmable logic controllers (PLCs), etc.

Further, device 2500 should not be interpreted as having any dependency relating to one or a combination of components illustrated in device 2500. For example, device 2500 may include one or more of computers, such as a laptop computer, a desktop computer, a mainframe computer, etc., or any combination or accumulation thereof.

Device 2500 can also include a bus 2508 configured to allow various components and devices, such as processors 2502, memory 2504, and local data storage 2510, among other components, to communicate with each other.

Bus 2508 can include one or more of any of several types of bus structures, including a memory bus or memory controller, a peripheral bus, an accelerated graphics port, and a processor or local bus using any of a variety of bus architectures. Bus 2508 can also include wired and/or wireless buses.

Local data storage 2510 can include fixed media (e.g., RAM, ROM, a fixed hard drive, etc.) as well as removable media (e.g., a flash memory drive, a removable hard drive, optical disks, magnetic disks, and so forth). One or more input/output (I/O) device(s) 2512 may also communicate via a user interface (UI) controller 2514, which may connect with I/O device(s) 2512 either directly or through bus 2508.

In one possible implementation, a network interface 2516 may communicate outside of device 2500 via a connected network. A media drive/interface 2518 can accept removable tangible media 2520, such as flash drives, optical disks, removable hard drives, software products, etc. In one possible implementation, logic, computing instructions, and/or software programs comprising elements of module 2506 may reside on removable media 2520 readable by media drive/interface 2518.

In one possible embodiment, input/output device(s) 2512 can allow a user (such as a human annotator) to enter commands and information to device 2500, and also allow information to be presented to the user and/or other components or devices. Examples of input device(s) 2512 include, for example, sensors, a keyboard, a cursor control device (e.g., a mouse), a microphone, a scanner, and any other input devices known in the art. Examples of output devices include a display device (e.g., a monitor or projector), speakers, a printer, a network card, and so on.

Various systems and processes of present disclosure may be described herein in the general context of software or program modules, or the techniques and modules may be implemented in pure computing hardware. Software generally includes routines, programs, objects, components, data structures, and so forth that perform particular tasks or implement particular abstract data types. An implementation of these modules and techniques may be stored on or transmitted across some form of tangible computer-readable media. Computer-readable media can be any available data storage medium or media that is tangible and can be accessed by a computing device. Computer readable media may thus comprise computer storage media. "Computer storage media" designates tangible media, and includes volatile and non-volatile, removable, and non-removable tangible media implemented for storage of information such as computer readable instructions, data structures, program modules, or other data. Computer storage media include, but are not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other tangible medium which can be used to store the desired information, and which can be accessed by a computer. Some of the methods and processes described above, can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, general-purpose computer, special-purpose machine, virtual machine, software container, or appliance) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Some of the methods and processes described above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for stimulating recovery of hydrocarbons from a subterranean rock formation traversed by a wellbore, comprising:

deploying a downhole tool at a treatment zone of the wellbore;

operating said downhole tool to create at least one notch in a wellbore surface at the treatment zone; and operating said downhole tool to supply a stimulating fluid to the treatment zone at a pressure less than formation breakdown pressure, wherein the notch facilitates wormhole formation at a corresponding position of the notch arising from dissolution of rock caused by reaction of the rock with the stimulating fluid, wherein the downhole tool is operated to create the at least one notch simultaneously with supplying the stimulating fluid to the treatment zone at a pressure less than formation breakdown pressure.

2. The method according to claim 1, wherein:

the notch facilitates wormhole formation by jump-starting wormhole initiation.

3. The method according to claim 1, wherein:

the notch reduces an induction time period.

4. The method according to claim 1, wherein:

the notch provides for controlled placement of a corresponding wormhole.

5. The method according to claim 1, wherein:

the notch provides for reducing volume of the stimulation fluid injected into the wellbore as compared to a volume of the stimulation fluid injected into the wellbore where no notches are present.

6. The method according to claim 1, wherein:

the notch is created by a nozzle structure that is configured to direct a high-pressure flow of stimulating fluid to a localized area of the wellbore surface.

7. The method according to claim 1, wherein:

the downhole tool is operated to create the at least one notch prior to supplying the stimulating fluid to the treatment zone at a pressure less than formation breakdown pressure.

8. The method according to claim 1, wherein:

the downhole tool is operated to create the at least one notch and supply the stimulating fluid to the treatment zone at a pressure less than formation breakdown pressure after isolating the treatment zone of the wellbore.

9. The method according to claim 1, wherein:

the operation of the downhole tool creates a plurality of notches in the wellbore surface of the treatment zone, wherein the plurality of notches facilitates wormhole formation at corresponding positions of the plurality of notches.

10. The method according to claim 9, wherein:

the plurality of notches are created by a plurality of nozzle structures each configured to direct a high-pressure flow of stimulating fluid to a localized area of the wellbore surface.

11. The method according to claim 1, wherein:

the stimulating fluid comprises an acid component.

12. A downhole tool that is deployable in a wellbore that traverses a subterranean rock formation traversed by a wellbore, the downhole tool for stimulating recovery of hydrocarbons from the subterranean rock formation, the downhole tool configured to create at least one notch in a wellbore surface at a treatment zone simultaneously with supplying a stimulating fluid to the treatment zone at a pressure less than formation breakdown pressure in a single run, wherein the notch facilitates wormhole formation at a corresponding position of the notch arising from dissolution of rock caused by reaction of the rock with the stimulating fluid.

13. The downhole tool according to claim 12, further comprising:

packers spaced apart from one another and configured to isolates the treatment zone.

14. The downhole tool according to claim 12, further comprising:

at least one nozzle structure supported by at least one moveable arm, wherein the nozzle structure is configured to direct a high-pressure flow of stimulating fluid to a localized area of the wellbore surface to create the notch.

15. The downhole tool according to claim 14, wherein:

the at least one moveable arm is configured for radial movement to permit the at least one nozzle structure to contact the wellbore surface.

16. The downhole tool according to claim 14, wherein:

the at least one moveable arm comprises at least one internal fluid passageway configured to carry stimulating fluid to the at least one nozzle structure.

17. The downhole tool according to claim 16, wherein:

the at least one moveable arm comprises at least one nozzle valve in fluid communication with the at least one internal fluid passageway, wherein the at least one nozzle valve is configured to selectively supply stimulating fluid to the at least one nozzle structure via the at least one internal fluid passageway.

18. The downhole tool according to claim 14, wherein:

the nozzle structure comprises at least one pad disposed about a nozzle exit, wherein the at least one pad is configured to contact the wellbore surface and provide a stand-off distance between the wellbore surface and the nozzle exit.

19. The downhole tool according to claim 18, wherein:

the nozzle structure is configured such that the stand-off distance is fixed.

20. The downhole tool according to claim 18, wherein:

the nozzle structure is configured such that the stand-off distance is adjustable by hydraulic operation or electromechanical operation.

21. The downhole tool according to claim 18, wherein:

the nozzle structure is configured to provide a flow path of stimulating fluid leading to the nozzle exit, wherein the flow path has decreasing cross-sectional size over its length such that pressure and velocity of stimulating fluid increases over the flow path and exits from the nozzle exit at sufficient pressure and velocity to create a notch in the wellbore surface.

22. The downhole tool according to claim 12, further comprising:

a plurality of nozzle structures supported by at least one moveable arm, wherein each nozzle structure is configured to direct a high-pressure flow of stimulating fluid to a localized area of the wellbore surface to create a plurality of notches in the wellbore surface.

23. The downhole tool according to claim 22, wherein:

the plurality of nozzle structures are supported by a plurality of moveable arms.

24. The downhole tool according to claim 12, wherein the downhole tool comprises a sliding sleeve configured to selectively inject the stimulating fluid from the downhole tool into the treatment zone.

* * * * *